United States Patent [19]

Arciszewski et al.

[11] Patent Number: 4,681,482

[45] Date of Patent: Jul. 21, 1987

[54] ROLLABLE TEMPORARY ROADWAY AND APPARATUS FOR ROLLING UP AN INSTALLED TEMPORARY ROADWAY

[75] Inventors: Bernhard Arciszewski, Bottrop-Kirchhellen; Hans-Norbert Wiedeck, Düsseldorf, both of Fed. Rep. of Germany

[73] Assignee: Fried. Krupp Gesellschaft mit beschränkter Haftung, Essen, Fed. Rep. of Germany

[21] Appl. No.: 848,386

[22] Filed: Apr. 4, 1986

[30] Foreign Application Priority Data

Apr. 6, 1985 [DE] Fed. Rep. of Germany ..... 3512589

[51] Int. Cl.[4] ..... E01C 5/16; E01C 9/08

[52] U.S. Cl. ..... 404/35; 14/1; 14/2.4; 238/10 R; 238/14; 242/94

[58] Field of Search ..... 14/1, 2.4; 404/35; 238/10 R, 14; 242/94, 86.52, 86.5 R

[56] References Cited

U.S. PATENT DOCUMENTS

| | | | |
|---|---|---|---|
| 462,587 | 11/1891 | Reagen | 242/86.5 R |
| 2,029,953 | 2/1936 | Sutilef | 242/94 |
| 2,140,676 | 12/1938 | Hohner | 242/94 |
| 3,252,173 | 5/1966 | Robinsky | 14/1 X |
| 3,258,800 | 7/1966 | Robinsky | 14/1 X |
| 3,350,013 | 10/1967 | Bergquist | 238/14 |
| 3,820,733 | 6/1974 | Roederer | 242/94 |
| 4,047,257 | 9/1977 | Bondarchuk, Sr. | 404/35 X |

FOREIGN PATENT DOCUMENTS

| | | | |
|---|---|---|---|
| 1943434 | 5/1966 | Fed. Rep. of Germany . | |
| 2248321 | 2/1976 | Fed. Rep. of Germany . | |
| 3241104 | 5/1984 | Fed. Rep. of Germany . | |
| 1027386 | 4/1966 | United Kingdom | 404/35 |
| 1169408 | 11/1969 | United Kingdom | 404/35 |
| 751883 | 7/1980 | U.S.S.R. | 404/35 |

*Primary Examiner*—Stephen J. Novosad
*Assistant Examiner*—John F. Letchford
*Attorney, Agent, or Firm*—Spencer & Frank

[57] ABSTRACT

A rollable temporary roadway is composed of individual supporting elements (2) which are articulately connected by hinge-like joints (7), each of which is formed by a bead (5) and the associated recess of a claw (6). The joints (7) are looped by at least one cable (10), with the cable being guided below the joints. A reeling device (20) for rolling up an installed temporary roadway (1) includes a pipe (21), hub members (22) which can be mounted on the pipe, and a cable arrangement (32, 33, 34).

14 Claims, 9 Drawing Figures

ROLLABLE TEMPORARY ROADWAY AND APPARATUS FOR ROLLING UP AN INSTALLED TEMPORARY ROADWAY

BACKGROUND OF THE INVENTION

The present invention relates to a temporary roadway of the type having a rolled state and having an unrolled state wherein the roadway extends along a line, the roadway including a plurality of supporting elements which are disposed beside one another in the direction of the line when the roadway is in its unrolled state, and including a plurality of hinge means for articulatedly connecting the supporting elements to one another. Each hinge means, which is disposed transverse to the line when the roadway is in its unrolled state, includes a bead affixed to one supporting element and a claw affixed to an adjacent element, the claw providing a recess that is engaged by the bead. The invention also relates to an apparatus for rolling up an installed temporary roadway.

Temporary roadways of the above-mentioned type are installed on ground that is not solid and that is usually uneven to permit heavy vehicles to travel over such ground. The ground may be muddy, sandy, or loose (as in coal or garbage dumps), or it may include water-soluble components (as the roads in a salt mine). The temporary roadway may provide roll-out panels or tracks in which the supporting elements are arranged one behind the other in a row, or it may be configured as a rollable carpet in which the supporting elements are arranged offset with respect to one another in a manner somewhat like bricks in a wall.

Temporary roadways with hinge joints in which a bead engages in a claw-shaped recess are disclosed, inter alia, in German (published) patent application No. 2,248,321 and in German (published without examination) patent application No. 3,241,104, where the supporting elements are configured as plates or hollow members having continuous upper and lower surfaces.

If a vehicle wheel is disposed on a hinge joint in the form of a bead and a claw between two supporting elements, with such joint being located over a hollow in the ground produced by erosion or the flow of water, considerable tensile stresses are produced in the hinge joint. As is the case in the temporary roadway disclosed in German application No. 3,241,104, the claw-shaped joint portion may open up so that the bead is pulled out or, as in the case of the temporary roadway according to German application No. 2,248,321, the angular web supporting the claw-shaped recess may break from the concentrated stress. Another drawback is that the joint, which is configured to have a loose fit, may become clogged with mud or dust, at least after some time of use. Such clogging would considerably impair the agility of the joint.

German application No. 2,248,321 discloses the use of a roller for installing and removing the temporary roadway, with such a roller being mounted either on a bearing block on the load surface of a utility vehicle or in a rigid frame articulated to the front of the vehicle. It is additionally known to use a winch-like device which is equipped with a central pipe, the pipe being provided over its entire length with a plurality of fixed supporting elements. The supporting elements are generally star-shaped and their peripheries are equipped, over the entire width of the device, with through-going supports or beams. Due to the large number of supporting elements and the through-going beams, this device is extremely heavy. After the temporary roadway has been rolled up, this device is raised by a vehicular crane with the aid of a cable and is loaded onto a transporting vehicle.

SUMMARY OF THE INVENTION

It is an object of the present invention to provide a temporary roadway of the above-mentioned type which is configured in such a manner that it has improved resistance to rupture while maintaining and retaining its flexibility, particularly with respect to point loads. Another object is to provide such a device which is composed of simple structure and which is able to roll up.

These objects are accomplished by providing a roadway which includes supporting elements that are connected by hinge means, each hinge means including a bead affixed to one supporting element and a claw affixed to another, and which also includes at least one cable that has loops and that is affixed to the supporting elements at the end of the roadway, with each loop surrounding a respective joint means. The longitudinal forces generated by vertical traffic loads and acting in the direction of the roadway are at least partially absorbed by the cable or cables. The use of a continuous cable corresponds, of course, to the use of a plurality of interconnected cables, one behind the other. The cable causes the vertical traffic load which acts on a particular point to be distributed to a plurality of supporting elements so that the individual link is relieved. Moreover, the cable also provides secure protection against mutual lateral displacement of the individual supporting elements, so that the otherwise customary large number of special securing elements are no longer required.

Looping the hinge joints with the cable and, as a consequence of this, employing the cable to absorb longitudinal forces, permits the angle enclosed by the claw-like recess to be reduced to 180° or less. This increases the mobility of the individual supporting elements with respect to one another (that is, larger angular movements are possible) and, furthermore, mud or dust that may have been enclosed is better able to escape from the hinge joint so that the hinge joint is kept flexible for a longer period of time.

The roadway may be configured as a rollable carpet, with the supporting elements having an offset arrangement. An advantage inherent in the use of cables is that a single cable can loop around different joints connected to the same supporting element in a rollable carpet.

Between the loops the cable may have segments that are positioned beneath the supporting elements. In this configuration the cable is tensioned, whenever it extends beneath the supporting elements, due to being subjected to a traffic load acting on a point above a hollow in the ground. Thus the resistance offered by the temporary roadway increases with the load.

To protect the cable or cables, they may be guided between the upper and lower sides of the supporting elements. This configuration of the trackway has the further advantage that the cable guidance is independent of the height of the supporting elements and is substantially independent of their angular positions with respect to one another.

Further loops may be provided at the ends of the cable to facilitate handling of the temporary roadway and to facilitate its fastening to the ground with conventional ground anchors.

A reeling device which includes an axle pipe that is longer than the roadway is wide, a rotary bearing disposed at either end of the axle pipe, a rod that is spaced apart from and parallel to the axle pipe, and means such as cables for connecting the bearings to the rods, may be employed for rolling up an installed temporary roadway. Such a reeling device is extraordinarily lightweight since, in the simplest case, only two hub members need to be mounted on the axle pipe, the hub members being provided with short wooden blocks. The hub members can be removed from the axle pipe so that transport is facilitated considerably, since the axle pipe, the hub members, and the other elements are less bulky when disassembled. The hub members may be displaced on the axle pipe, which permits the reeling device to be adapted to temporary roadways of different widths. When worn, the wooden blocks can also be quickly exchanged individually. During rolling up of the temporary roadway, the loops of the cables disposed along the sides can be attached to a wooden block. The wooden blocks are preferably less than half as long as the width of the temporary roadway and, better still, between 6% and 16% of the width. Such lengths result in considerable savings in weight and thus further facilitate transport.

The reeling device can be pulled by a vehicle by using pulling elements such as cables, and thus the temporary roadway can be rolled up. The direction of rolling can be corrected by the driver of the vehicle, who simply monitors it through his rear view mirror. Then the reeling device together with the rolled-up temporary roadway can be picked up by a vehicular crane and loaded onto a transporting vehicle. For transport, the axle pipe may be pulled out of the hub members, thus further reducing the weight to be transported. The axle pipe is also not required when the rolled-up temporary roadways are put away in storage.

For unrolling the temporary roadway, the transverse rod and the pulling elements can be omitted.

DESCRIPTION OF THE PREFERRED EMBODIMENTS

Figure 1:
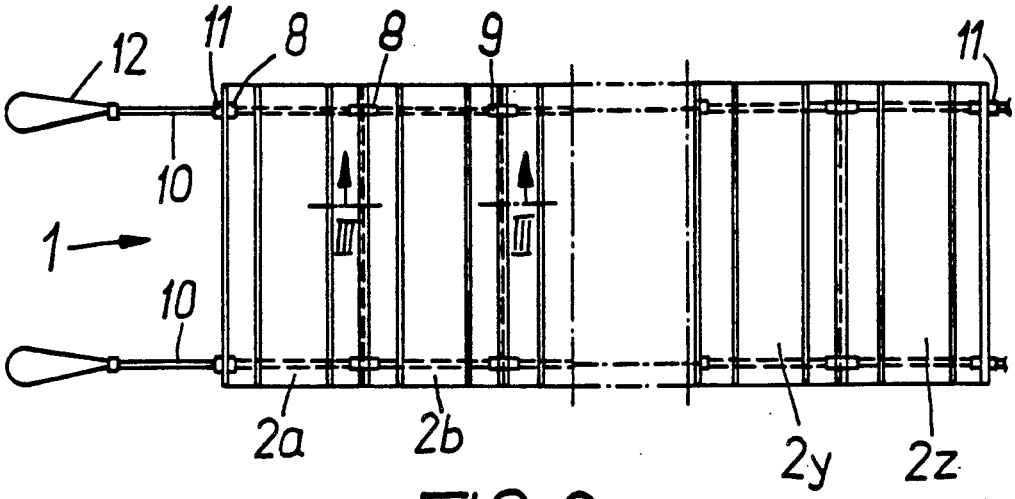
FIG. 1 is a plan view of a temporary roadway in accordance with the present invention, the supporting elements being provided in the form of a row of rollable panels.
Figure 2:
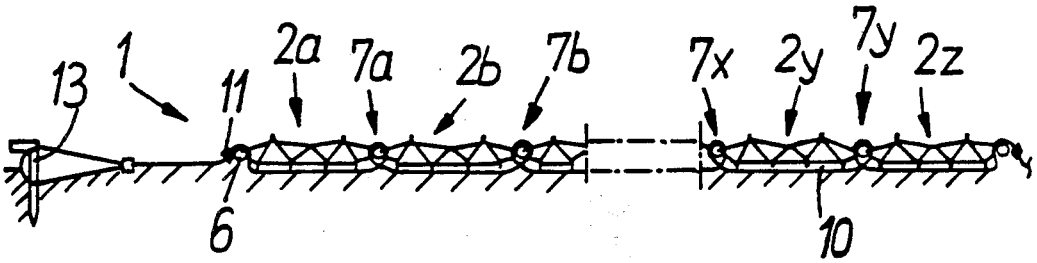
FIG. 2 is a side view of the temporary roadway according to FIG. 1.
Figure 3:
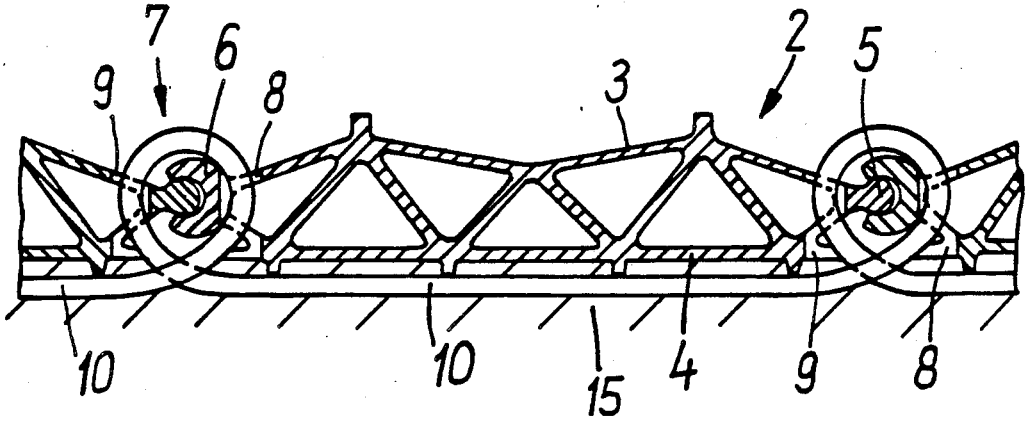
FIG. 3 is an enlarged cross-sectional view taken along the line III—III of FIG. 1.

In FIGS. 1 to 3, a temporary roadway 1 in the form of a roll-up mat has a plurality of plate-shaped supporting elements 2, which are arranged in a row one behind the other and which are marked individually as 2*a*, . . . , 2*z* in FIGS. 1 and 2. Supporting elements 2 are preferably extrusion molded hollow members and each have continuous upper and lower sides 3 and 4. The material employed for the supporting elements 2 may be, for example, an aluminum-magnesium-silicon alloy (AlMgSi), and the cavity formed between the upper side 3 and the lower side 4 may be filled with polyurethane foam. On their longitudinal edges facing adjacent supporting elements 2, the supporting elements 2 are alternatingly provided with a cylindrical bead 5 and a claw 6 which has a hollow cylindrical recess. Together, the bead 5 and the claw 6 form a hinge-like joint 7. Immediately before and behind hinge joint 7, for example in the vicinity of their frontal faces, supporting elements 2 are provided with holes 8 and 9, with a cable 10 passing through these holes.

Proceeding from the left in FIGS. 1–3, cable 10 is placed around claw 6 of the first supporting element 2*a*, passes through the lower side 4 of that supporting element, is looped in a circle of 360° around the first hinge joint 7*a*, continues along the lower surface 4 of the second supporting element 2*b*, around the second hinge joint 7*b*, etc., until it has been looped around bead 5 of the last supporting element 2*z*.

Before the first supporting element 2*a* and before the last supporting element 2*z*, clamping elements 11 prevent cables 10 from inadvertently changing their position with respect to roadway 1. At their ends, cables 10 are provided with eyes or loops 12 with which they can be fixed to the ground 15 by means of ground anchors 13.

Figure 4:
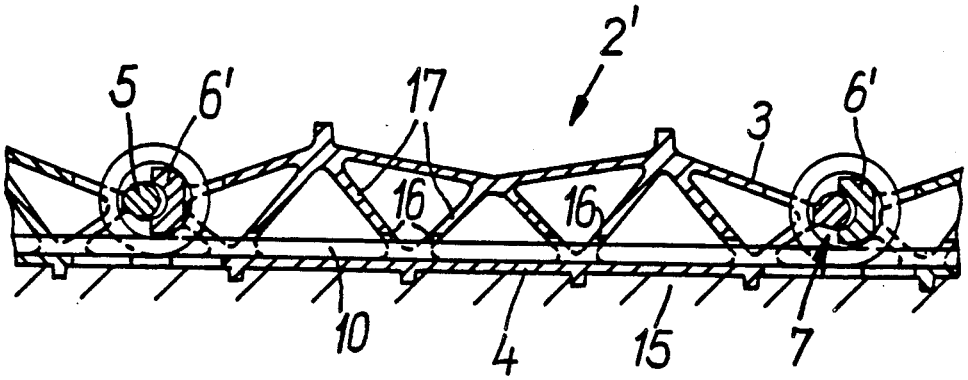
FIG. 4 is an enlarged longitudinal sectional view of part of another embodiment of the temporary roadway.

In a further embodiment shown in FIG. 4, the supporting elements 2' are additionally provided with bores 16 which extend parallel to the lower side 4 in webs 17 disposed between upper side 3 and lower side 4. In this case, cable 10 is guided between upper side 3 and lower side 4, but otherwise it is placed around hinge joints 7 in the manner described above. The claws 6' of hinge joints 7 enclose the associated beads 5 only over an angle of 180°.

Figure 5:
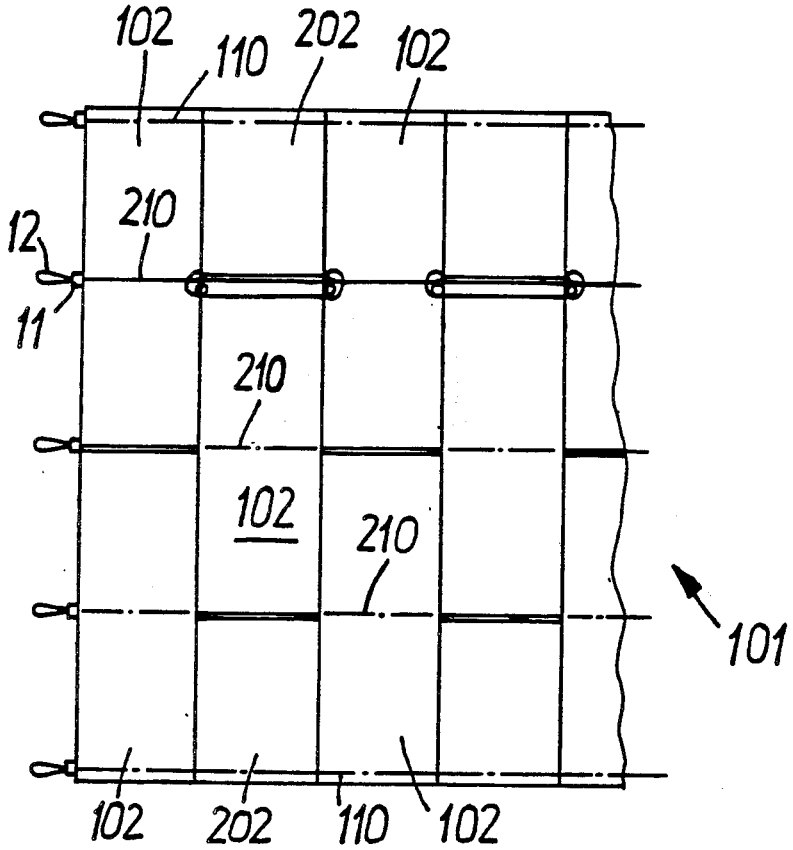
FIG. 5 is a plan view illustrating another embodiment of the present invention, the supporting elements being arranged in an offset manner to provide a rollable carpet.
Figure 9:
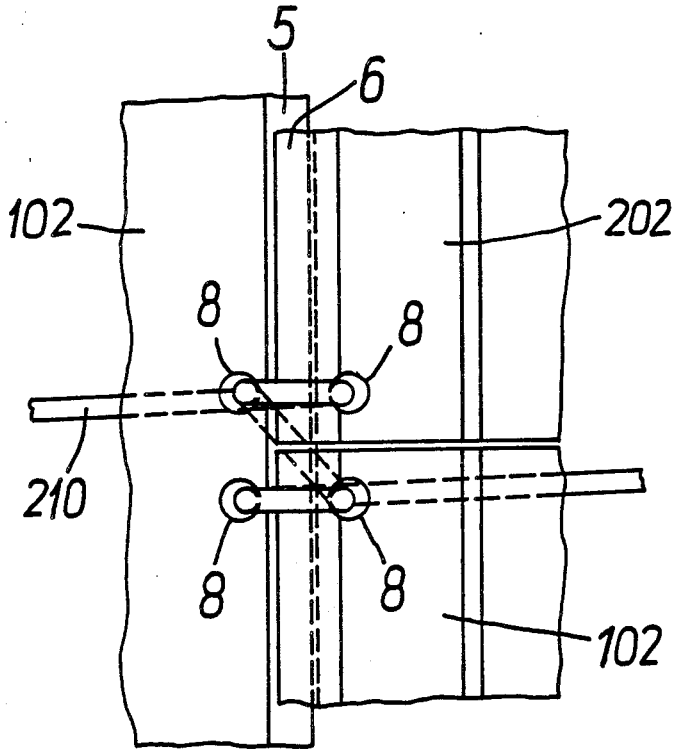
FIG. 9 is a fragmentary enlarged plan view of two adjacent hinge means of a rollable carpet according to FIG. 5 and of the respective pair of loops of the cable.

In the embodiment according to FIG. 5, the temporary roadway is configured as a roll-up carpet 101 and may be used, for example, as a landing area for helicopters. Roll-up carpet 101 is provided with two different types of supporting elements, identified by reference numerals 102 and 202. Supporting elements 202 have half the length of supporting elements 102, but otherwise are of the same construction. Supporting elements 102 and 202 are arranged offset with respect to one another, in an arrangement like bricks in a wall. At each of the outer side edges of the roll-up carpet 101, a cable 110 is wound around the hinge joints 7 of each supporting element 102 and 202 in the manner described above. At a distance equal to the length of one (shorter) supporting element 202 from either side edge of the roll-up carpet, a further cable 210 is guided along the roll-up carpet 101, initially either underneath lower side 4 of the first supporting element 102 as described in connection with FIG. 3 or between upper side 3 and lower side 4 as described in connection with FIG. 4. Then each cable 210 is looped around the joint 7 formed with one of the next following shorter suppporting elements 202 and immediately thereafter around the joint 7 formed with the supporting element 102 adjacent thereto, etc. as illustrated in more detail in FIG. 9. Finally, a middle cable 210 is installed, with loop pairs again being employed to surround each of side-by-side joints 7. From FIG. 5 it will be apparent that roll-up carpet 101 has two outer cables 110 which extend from one end of carpet 101 to the other, each cable 110 having spaced-apart single loops as illustrated in FIG. 3 or FIG. 4. Carpet 101 also has three inner cables 210 which extend from one end of carpet 101 to the other, each cable 210 having loop pairs according to FIG. 9.

Figure 6:
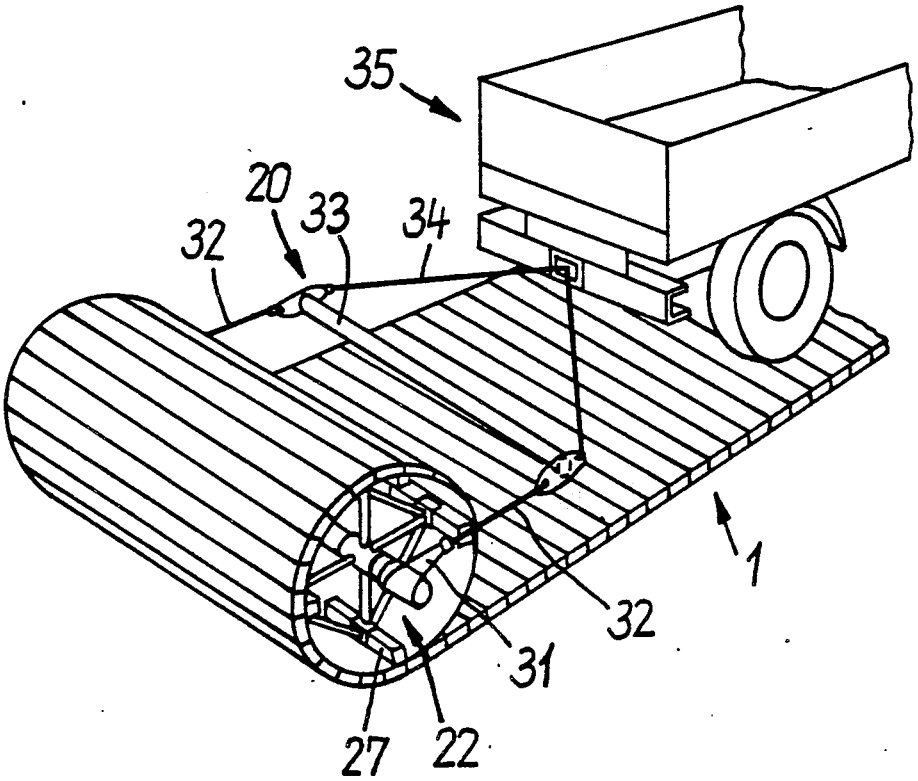
FIG. 6 is a perspective view of a reeling device for rolling up a temporary roadway, with the device being attached to a vehicle.
Figure 7:
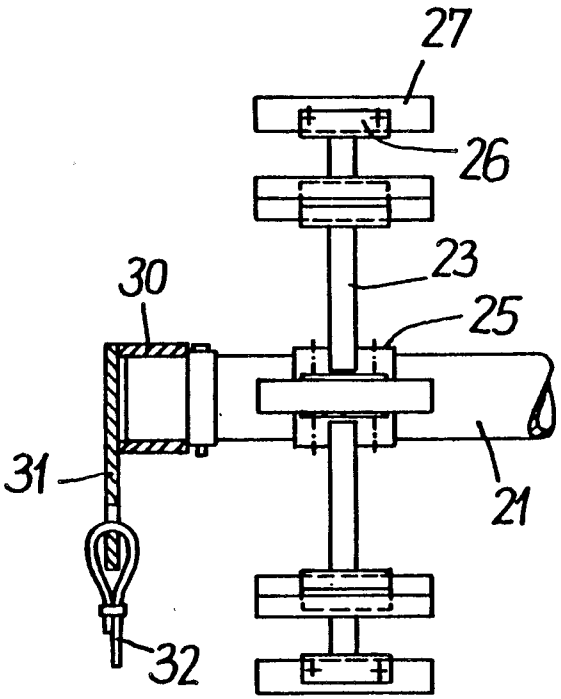
FIG. 7 is a top view, partially in section, of a part of the reeling device, and illustrates a hub member and a rotary bearing mounted on one end of the axle pipe.
Figure 8:
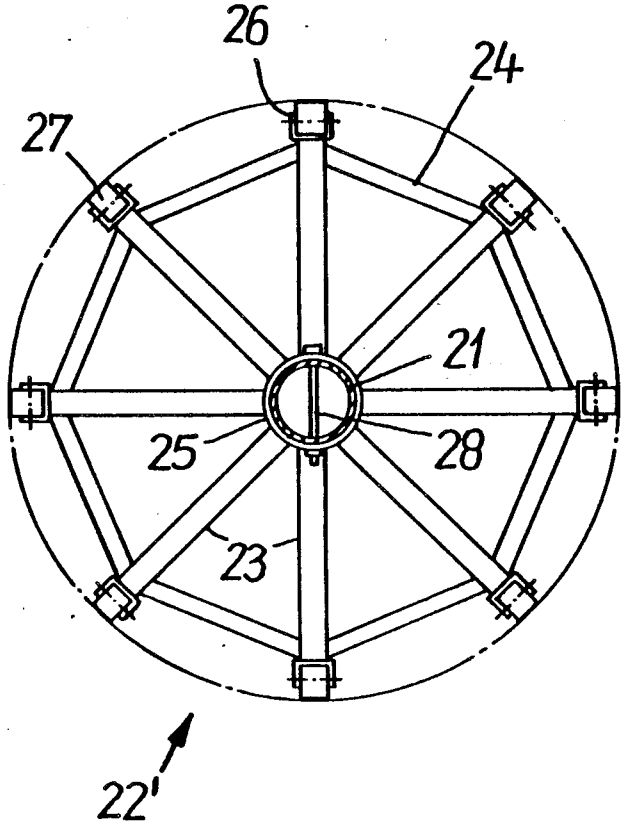
FIG. 8 is a front view, partially in section, of a hub member mounted on the axle pipe.

With reference next to FIGS. 6 to 8, a reeling device 20 for rolling up the temporary roadway 1 includes a central axle pipe 21 equipped with two hub members 22 (FIG. 6) or 22' (FIG. 8, which employ a different number of tubular spokes 23). Reference number 24 identifies tubular connecting supports. At its center, each hub member 22 or 22' is provided with a sleeve 25 whose inner diameter provides a loose fit with the outer diameter of axle pipe 21. U-shaped holders 26 are attached at the outer ends of spokes 23 to releasably fasten elongated wooden blocks 27. After being pushed onto pipe 21, hub members 22 or 22' can be fixed with the aid of a pin or bolt 28.

At each end of pipe 21, there is provided a sleeve or rotary bearing 30 equipped with a pulling eye or tongue 31 which has a loose fit with respect to pipe 21. Cables 32 connect pull tongues 31 to the ends of traverse rod 33, which forms part of a triangular cable arrangement 34 which is suitable for engagement in a crane hook (not illustrated) or in the hitch of a vehicle 35.

To unroll a roll-up roadway 1, the roadway 1 is first lowered to the ground with the aid of a vehicular crane (not illustrated) or with a crane (not shown) built on the transporting vehicle 35. Then bushings 30 together with cables 32 and 34 and traverse rod 33 can be removed from pipe 21 and it is sufficient for the bumper of the vehicle 35 to press the rolled-up roadway 1 in the unrolling direction.

To roll up the roadway 1, the reeling device 20 is placed at the beginning end of roadway 1 and the loops 12 of cable 10 are fastened to the closest wooden blocks 27. Then sleeves 30 are placed onto pipe 21 and the triangular cable arrangement 34 is coupled to the utility vehicle 35. Roadway 1 can thus be wound up without effort, with the driver of vehicle 35 being able to check that roadway 1 is being wound up correctly or to make any corrections by glancing in his rear view mirror and making minor changes in his direction of travel.

It will be understood that the above description of the present invention is susceptible to various modifications, changes and adaptations, and the same are intended to be comprehended within the meaning and range of equivalents of the appended claims.

What we claim is:

1. A temporary roadway having first and second ends, the roadway additionally having a rolled state and an unrolled state wherein the roadway extends along a line between the first and second ends, comprising:

a plurality of supporting elements which are disposed beside one another in the direction of the line when the roadway is in its unrolled state;

a plurality of hinge means, disposed transverse to the line when the roadway is in its unrolled state, for articulatedly connecting said supporting elements to one another, each hinge means including a bead affixed to a respective supporting element and a claw affixed to a respective supporting element adjacent said bead, said claw having a recess which is engaged by said bead; and at least one cable which has loops and which is fastened to supporting elements at both ends of the roadway, each loop separately surrounding a respective hinge means.

2. The roadway of claim 1, wherein said supporting elements have top sides and bottom sides, wherein said at least one cable has portions between said loops that are disposed below said bottom sides of said supporting elements when the roadway is in its unrolled state.

3. The roadway of claim 1, wherein said supporting elements have top sides and bottom sides, and wherein said at least one cable has portions between said loops that are disposed between said top and bottom sides of said supporting elements.

4. The roadway of claim 1, wherein said at least one cable has loops at the ends of the roadway.

5. The roadway of claim 1, wherein said plurality of supporting elements includes a first supporting element and a pair of second supporting elements that are disposed adjacent each other and adjacent said first supporting element, wherein said plurality of hinge means include a first hinge means connecting said first supporting element and one of said second supporting elements and a second hinge means connecting said first supporting element and the other of said second supporting elements, and wherein said at least one cable loops around said first hinge means and immediately thereafter around said second hinge means.

6. The roadway of claim 5, wherein said supporting elements have top sides and bottom sides, and wherein said at least one cable has portions between said loops that are disposed below said bottom sides of said supporting elements when the roadway is in its unrolled state.

7. The roadway of claim 5, wherein said supporting elements have top sides and bottom sides, and wherein said at least one cable has portions between said loops that are disposed between said top and bottom sides of said supporting elements.

8. The roadway of claim 5, wherein said at least one cable has loops at the ends of the roadway.

9. Reel means for rolling up the roadway of claim 1, said reel means comprising a pipe having a length that is greater than the width of said roadway; a pair of rotary bearings, each rotary bearing being disposed at a respective end of said pipe; a rod spaced apart from and parallel to said pipe; and means for connecting said bearings and said rod.

10. The reel means of claim 9, further comprising hub members about which said roadway can be coiled, said hub members being configured to be pushed onto said pipe and retained there.

11. The reel means of claim 10, wherein each hub member has a periphery and includes a plurality of elongated wooden blocks attached at the periphery, said blocks being disposed parallel to said pipe and having lengths that are less than half of the width of the roadway.

12. The reel means of claim 11, wherein each block has a length ranging from 6% to 16% of the width of the roadway.

13. A reel device for rolling up a temporary roadway having a rolled state and an unrolled state, the roadway additionally having a width, comprising: a pipe having a length that is greater than the width of said roadway; a pair of rotary bearings, each rotary bearing being disposed at a respective end of said pipe; a rod spaced apart from and parallel to said pipe; means for connecting said bearings and said rod; and hub members about which said roadway can be coiled, said hub members being configured to be pushed onto said pipe and retained there, wherein each hub member has a periphery and includes a plurality of elongated wooden blocks attached at the periphery, said blocks being disposed parallel to said pipe and having lengths that are less than half the width of the roadway.

14. The reel device of claim 13, wherein each block has a length ranging from 6% to 16% of the width of the roadway.

* * * * *